United States Patent [19]

McCord

[11] 3,952,867

[45] Apr. 27, 1976

[54] DISPOSABLE TOOTH CLEANING APPARATUS

[76] Inventor: William F. McCord, 1026 Shorewood Drive, Seabrook, Tex. 77586

[22] Filed: Mar. 19, 1975

[21] Appl. No.: 560,016

[52] U.S. Cl. ..... 206/229; 132/84 R; 401/7

[51] Int. Cl.[2] ..... B65D 35/22; B65D 85/00

[58] Field of Search ..... 206/229, 216; 132/84 R, 132/84 D; 401/6, 7; 222/107

[56] References Cited

UNITED STATES PATENTS

| | | | |
|---|---|---|---|
| 3,298,507 | 1/1967 | Micciche | 401/6 |
| 3,534,887 | 10/1970 | Ginsberg | 206/229 |

*Primary Examiner*—William T. Dixson, Jr.
*Attorney, Agent, or Firm*—Fulbright & Jaworski

[57] ABSTRACT

A disposable tooth cleaning apparatus including a sealed package having first and second separate compartments. The first compartment includes ingestible toothpaste for cleaning the teeth which can be swallowed without causing any unpleasantness and therefore does not require mouth rinsing or available water facilities. The second compartment includes an applicator having an opening and is sized and shaped for insertion over a finger whereby the teeth may be brushed by the finger after applying the toothpaste to the applicator. The applicator includes an outer layer having a soft absorbent non-woven fabric for supporting the toothpaste and moisture with the non-woven fabric being interwoven with reenforcing fibers which support the outer layer and provide a scrubbing surface for cleaning the teeth. The applicator also includes an inner layer of plastic bonded to the outer layer for providing a support backing to the outer layer and for keeping the finger dry. The edges of the applicator are joined together by heat sealing the outer edges of the inner plastic layer together.

2 Claims, 3 Drawing Figures

DISPOSABLE TOOTH CLEANING APPARATUS

BACKGROUND OF THE INVENTION

It is known in the art to provide disposable teeth cleaning devices which can be applied to a finger for brushing the teeth. For example, see U.S. Pat. Nos. 2,092,987; 2,419,896; 2,763,885; and 3,124,824. However, such prior art devices have been complicated, expensive, and have not been suitably self-sufficient to allow their universal use. Primarily, they are not fully designed for completely portable and disposable use as it is necessary to use water to rinse with afterwards. With the present apparatus utilizing a completely ingestible non-foaming toothpaste, it is not necessary to rinse after brushing.

The need for regular and frequent teeth cleaning is well known in order to maintain oral hygiene and prevent bacterial buildup. However, people frequently are at locations and do not have the necessary equipment or facilities normally required for brushing their teeth and rinsing their mouth. Furthermore, regular toothpaste generally includes a foaming detergent, which even though flavored, can cause gastric distress if swallowed, which can be unpleasant. In some situations, such as the case of invalids, water facilities are not readily convenient for rinsing the mouth.

The present invention, therefore, is directed to various improvements in a disposable tooth cleaning apparatus in which both a finger applicator and ingestible toothpaste is provided in an individual package for a one-time use thereby overcoming the prior problems of complicated, expensive, and unsanitary types of devices.

SUMMARY

The present invention is directed to a completely disposable tooth cleaning apparatus in which an individual sealed package is provided having first and second separate compartments. The first compartment includes an ingestible toothpaste whereby the user may brush his teeth and swallow the toothpaste without rinsing his mouth out. This allows the user to be able to brush his teeth without the need of water facilities and without unpleasant effects. The second compartment includes an applicator having an opening and sized and shaped for insertion over a finger for brushing the teeth after applying the ingestible toothpaste to the applicator.

It is a further object of the present invention to provide an applicator having an outer layer including a soft absorbent non-woven fabric for supporting and holding the toothpaste and moisture, the outer layer being interwoven with reenforcing fibers for supporting the paper and providing a roughened or non-smooth surface for cleaning the teeth. The applicator may also be provided with an inner layer of plastic bonded to the outer layer for supplying a support backing to the outer layer and for keeping the finger dry.

It is a further object of the present invention to provide an applicator wherein the outer lay includes cellulose material and the interwoven fibers and plastics are of a polymer material such as polyethylene, polypropylene or the like.

Still other and further objects, features and advantages will be apparent from the following description of the presently preferred embodiment of the invention, given for the purpose of disclosure and taken in conjunction with the accompanying drawings.

DESCRIPTION OF THE PREFERRED EMBODIMENT

Figure 1:
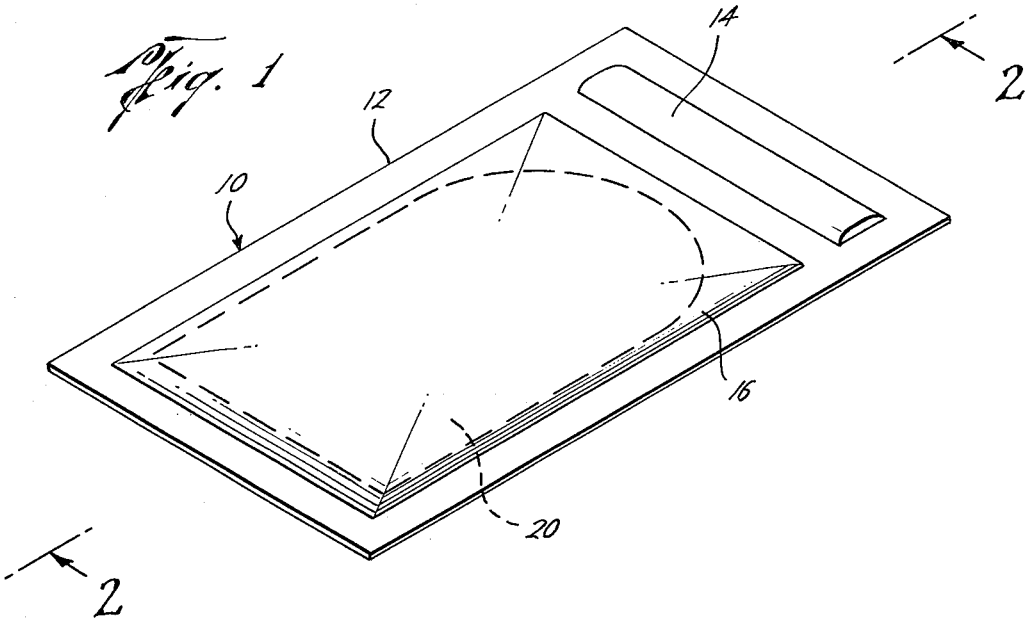
FIG. 1 is a perspective view of the pre-packaged disposable tooth cleaning apparatus of the present invention.

Referring now to the drawings and particularly to FIG. 1, the reference numeral 10 generally indicates the disposable and pre-packaged individual tooth cleaning apparatus of the present invention and includes a sealed package 12 having a first sealed compartment 14 and a second sealed compartment 16. The compartment 14 includes an ingestible toothpaste 18, which while cleaning the teeth will allow the user to use the tooth cleaner regardless of the user's location and does not require water facilities for rinsing the mouth. For example, this is particularly advantageous for invalids or bed-restricted patients who are unable to obtain ready access to mouth-rinsing facilities. Furthermore, the ingestible toothpaste 18, since it does not include detergents or other irritants, may be easily swallowed without causing gastric distress or other unpleasantness when swallowed. One suitable formula for ingestible toothpaste which has been found to be satisfactory is as follows:

| | |
|---|---|
| Insoluble sodium metaphosphate | 1200 grams |
| Dicatcium phosphate | 200 grams |
| Glycerine | 1160 grams |
| Sodium carboxynathylcellulose | 50 grams |
| Saccharin | 4 grams |
| Water | 1390 grams |
| Oil of spearmint | 16 grams |

Figure 2:
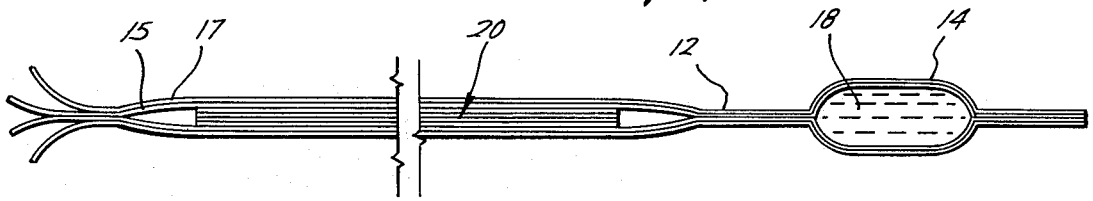
FIG. 2 is a cross-sectional view taken along the line 2—2 of FIG. 1.
Figure 3:
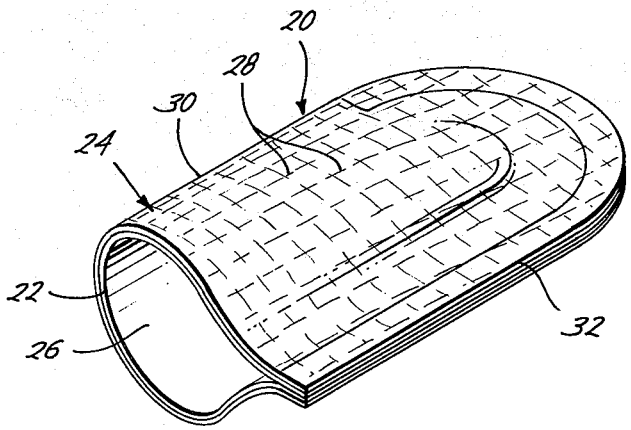
FIG. 3 is a perspective view of the finger applicator of the present invention.

The second sealed compartment 16 of the package 12 which suitably may be a sealed foil package 15 having a wrapper 17, contains the applicator 20. The applicator 20 is packaged in a flat form, as best seen in FIG. 2, and as best seen in FIG. 3 is enclosed, but is sized and shaped for insertion over a finger, such as an index finger, and includes an opening 22 for inserting the applicator over the finger where it may be held between the index finger and the thumb for brushing the teeth. The applicator 20 includes an outer layer 24 and an inner layer 26. The outer layer 24 is comprised of a soft non-woven fabric 30 for supporting the toothpaste 18 and any moisture and is interwoven with reenforcing fibers 28 for supporting the layer 24 and providing the fabric 30 with a non-smooth or slightly roughened surface for aiding in cleaning the teeth. The inner layer 26 is of a suitable plastic bonded to the outer layer 24 to provide a support backing to the outer layer 24, for keeping the inserted finger dry and for providing a sealing edge for forming the finger compartment. Preferably, the fabric 30 includes a cellulose material and the fibers 28 and inner layer 26 are of any suitable polymer material such as polyethylene or polypropylene. One suitable material which is satisfactory for use in forming the applicator 20 is stock No. 43530 as manufactured by Kimberley-Clark. The applicator 20 may be suitably cut out of the raw material, folded over and the mating free edges 32 may be joined together by heat sealing the outer edge whereby the inner plastic layer 26 will be bonded together with a heat seal.

In use, the compartment 16 is opened and the finger applicator 20 is removed, the compartment 14 is opened and the toothpaste 18 applied to the outer layer 24 of the applicator 20. A finger is inserted into the opening 22 and the applicator 20 is held firmly between the thumb and index finger for brushing the teeth. After use, all of the components of the individual disposable tooth cleaning apparatus 10 may be thrown away.

The present invention, therefore, is well adapted to carry out the objects and attain the ends and advantages mentioned as well as others inherent therein. While a presently preferred embodiment of the invention has been given for the purpose of disclosure, numerous changes may be made without departing from the spirit and scope of the invention as hereafter claimed.

What is claimed is:

1. A disposable tooth cleaning apparatus comprising, a sealed package having first and second separate compartments, the first compartment includes ingestible non-foaming toothpaste, the second compartment includes an applicator having an opening and sized and shaped for insertion over the index finger, said applicator having an outer layer including a soft absorbent non-woven fabric for supporting the toothpaste and moisture, said fabric being interwoven with reenforcing fibers for supporting the fabric and providing a non-smooth surface for cleaning the teeth, said applicator having an inner layer of plastic bonded to the outer layer for providing a support backing to the outer layer and for keeping the finger dry, and the edges of the applicator being joined together by heat sealing the outer edge of the inner layer together.

2. The apparatus of claim 1 wherein the outer layer includes a cellulose material, the fibers and the plastic being of a polymer material.

* * * * *